US008899138B2

(12) United States Patent
Brown

(10) Patent No.: US 8,899,138 B2
(45) Date of Patent: Dec. 2, 2014

(54) FIREARM HAVING A HANDLE ASSEMBLY FOR CHARGING AND FORWARD ASSIST

(75) Inventor: Michael J. Brown, Baltimore, MD (US)

(73) Assignee: Adcor Industries, Inc., Baltimore, MD (US)

( * ) Notice: Subject to any disclaimer, the term of this patent is extended or adjusted under 35 U.S.C. 154(b) by 0 days.

(21) Appl. No.: 13/608,829

(22) Filed: Sep. 10, 2012

(65) Prior Publication Data

US 2013/0061737 A1 Mar. 14, 2013

Related U.S. Application Data

(60) Provisional application No. 61/573,555, filed on Sep. 8, 2011.

(51) Int. Cl.
*F41A 7/00* (2006.01)
*F41A 3/72* (2006.01)

(52) U.S. Cl.
CPC ..... *F41A 3/72* (2013.01)
USPC ..... 89/1.4; 89/191.01

(58) Field of Classification Search
USPC ..... 89/1.4, 1.42, 179, 191.01, 191.02, 192
See application file for complete search history.

(56) References Cited

U.S. PATENT DOCUMENTS

| | | | |
|---|---|---|---|
| 1,379,989 | A | 5/1921 | Johnson |
| 1,402,459 | A | 1/1922 | Swebilius |
| 1,846,993 | A | 2/1932 | Destree |
| 1,878,038 | A | 9/1932 | Von Frommer |
| 2,056,577 | A | 10/1936 | Kehne |
| 2,341,767 | A | 2/1944 | Gans |
| 2,454,885 | A | 11/1948 | Robinson |
| 2,462,119 | A | 2/1949 | Moore |
| 2,685,754 | A | 8/1954 | Crittendon et al. |

(Continued)

FOREIGN PATENT DOCUMENTS

| | | | |
|---|---|---|---|
| EP | 0207058 | A2 | 12/1986 |
| EP | 2045564 | A2 | 4/2009 |
| FR | 1349766 | A | 1/1964 |
| GB | 1046322 | A | 10/1966 |

OTHER PUBLICATIONS

Article entitled "M16 rifle" from Wikipedia, the free encyclopedia dated Jun. 2008; http://en.wikipedia.org/wiki/M-16_rifle.
Article entitled "M4 Carbine" from Wikipedia, the free encyclopedia dated Jun. 2008; http://en.wikipedia.org/wiki/M4_carbine.
Animation entitled "How an AR15 Works" from the website dated Jun. 2008; www.barnesengineering.com/AR15animation/index.htm.

(Continued)

*Primary Examiner* — Bret Hayes
*Assistant Examiner* — Derrick Morgan
(74) *Attorney, Agent, or Firm* — Howard & Howard Attorneys PLLC

(57) ABSTRACT

A firearm includes a receiver defining a receiver bore and a bolt carrier disposed in the receiver bore. The bolt carrier is moveable relative to the receiver along a longitudinal axis between a firing position and a rearward position. A hand guard is coupled to the receiver and an elongated member is fixed relative to the bolt carrier in the hand guard. A handle assembly is slideably engaged with the elongated member in the hand guard and the handle assembly is moveable toward the receiver to define a charging motion. The bolt carrier presents a first surface and the handle assembly terminates at a terminal surface aligned with the first surface along the longitudinal axis. The terminal surface of the handle assembly abuts the first surface of the bolt carrier when the handle assembly is moved in the charging motion.

29 Claims, 6 Drawing Sheets

(56) References Cited

U.S. PATENT DOCUMENTS

| | | | | |
|---|---|---|---|---|
| 2,752,826 | A | 7/1956 | Simpson | |
| 2,775,166 | A | 12/1956 | Janson | |
| 2,780,145 | A | 2/1957 | Saive | |
| 2,783,685 | A | 3/1957 | Green | |
| 2,882,635 | A | 4/1959 | Hill | |
| 2,951,424 | A | 9/1960 | Stoner | |
| 3,176,424 | A | 4/1965 | Hoge | |
| 3,198,076 | A | 8/1965 | Stoner | |
| 3,225,653 | A * | 12/1965 | Packard | 89/1.4 |
| 3,236,155 | A | 2/1966 | Sturtevant | |
| 3,255,667 | A | 6/1966 | Walther | |
| 3,300,889 | A | 1/1967 | Baker | |
| 3,323,418 | A | 6/1967 | Loffler | |
| 3,368,298 | A | 2/1968 | Browning | |
| 3,397,473 | A | 8/1968 | Browning | |
| 3,405,470 | A | 10/1968 | Wesemann | |
| 3,592,101 | A | 7/1971 | Vartanian et al. | |
| 3,618,457 | A | 11/1971 | Miller | |
| 3,619,926 | A | 11/1971 | Alday | |
| 3,675,534 | A * | 7/1972 | Beretta | 89/185 |
| 3,686,998 | A | 8/1972 | Seifried | |
| 3,742,636 | A | 7/1973 | Dealy et al. | |
| 3,771,415 | A | 11/1973 | Into et al. | |
| 3,774,498 | A | 11/1973 | Moller et al. | |
| 3,776,095 | A | 12/1973 | Atchisson | |
| 3,938,271 | A | 2/1976 | Hyytinen | |
| 3,938,422 | A | 2/1976 | Tellie | |
| 3,960,053 | A | 6/1976 | Conley | |
| 3,969,980 | A | 7/1976 | Brandstatter et al. | |
| 3,999,461 | A | 12/1976 | Johnson et al. | |
| 4,020,741 | A | 5/1977 | Junker | |
| 4,044,487 | A | 8/1977 | Hutton et al. | |
| 4,088,057 | A | 5/1978 | Nasypany | |
| 4,125,054 | A | 11/1978 | Jennie | |
| 4,244,273 | A | 1/1981 | Langendorfer, Jr. et al. | |
| 4,246,830 | A | 1/1981 | Krieger | |
| 4,358,986 | A | 11/1982 | Giorgio | |
| 4,389,920 | A | 6/1983 | Dufour, Sr. | |
| 4,398,448 | A | 8/1983 | LaFever | |
| 4,505,182 | A * | 3/1985 | Sullivan | 89/132 |
| 4,553,469 | A * | 11/1985 | Atchisson | 89/191.02 |
| 4,565,113 | A | 1/1986 | Bunning | |
| 4,654,993 | A | 4/1987 | Atchisson | |
| 4,663,875 | A | 5/1987 | Tatro | |
| 4,689,911 | A | 9/1987 | White | |
| 4,693,170 | A | 9/1987 | Atchisson | |
| 4,703,826 | A | 11/1987 | Byron | |
| 4,756,228 | A | 7/1988 | Roth | |
| 4,765,224 | A | 8/1988 | Morris | |
| 4,766,800 | A | 8/1988 | Miller et al. | |
| 4,867,039 | A | 9/1989 | Dobbins | |
| 4,893,547 | A | 1/1990 | Atchisson | |
| 4,972,617 | A | 11/1990 | Major | |
| 5,198,600 | A | 3/1993 | E'Nama | |
| 5,343,650 | A | 9/1994 | Swan | |
| 5,351,598 | A | 10/1994 | Schuetz | |
| 5,540,008 | A | 7/1996 | Kirnstatter | |
| 5,606,825 | A * | 3/1997 | Olsen | 42/69.01 |
| 5,821,445 | A | 10/1998 | Guhring | |
| 5,824,923 | A | 10/1998 | Kondoh et al. | |
| 5,827,992 | A | 10/1998 | Harris et al. | |
| 5,918,401 | A | 7/1999 | Rowlands | |
| 5,945,626 | A | 8/1999 | Robbins | |
| 6,019,024 | A * | 2/2000 | Robinson et al. | 89/1.42 |
| 6,134,823 | A | 10/2000 | Griffin | |
| 6,257,114 | B1 | 7/2001 | Murello | |
| 6,311,603 | B1 | 11/2001 | Dunlap | |
| 6,418,655 | B1 | 7/2002 | Kay | |
| 6,453,594 | B1 | 9/2002 | Griffin | |
| 6,481,145 | B2 | 11/2002 | Weichert et al. | |
| 6,484,430 | B1 * | 11/2002 | Robinson et al. | 42/25 |
| 6,499,246 | B1 | 12/2002 | Zedrosser | |
| 6,508,158 | B2 | 1/2003 | Murello | |
| 6,564,491 | B2 | 5/2003 | Murello | |
| 6,609,321 | B2 | 8/2003 | Faifer | |
| 6,619,592 | B2 | 9/2003 | Vignaroli et al. | |
| 6,625,916 | B1 | 9/2003 | Dionne | |
| 6,634,274 | B1 | 10/2003 | Herring | |
| 6,722,255 | B2 | 4/2004 | Herring | |
| 6,732,466 | B2 | 5/2004 | Bentley | |
| 6,782,791 | B2 | 8/2004 | Moore | |
| 6,829,858 | B2 | 12/2004 | Gablowski | |
| 6,848,351 | B1 | 2/2005 | Davies | |
| 7,000,345 | B1 | 2/2006 | Kay | |
| 7,131,228 | B2 | 11/2006 | Hochstrate et al. | |
| RE39,465 | E | 1/2007 | Swan | |
| 7,219,463 | B2 | 5/2007 | Wossner | |
| 7,231,861 | B1 * | 6/2007 | Gauny et al. | 89/1.4 |
| 7,240,600 | B1 | 7/2007 | Bordson | |
| 7,418,898 | B1 | 9/2008 | Desomma | |
| 7,448,307 | B1 | 11/2008 | Dafinov | |
| 7,461,581 | B2 | 12/2008 | Leitner-Wise | |
| 7,469,624 | B1 | 12/2008 | Adams | |
| 7,478,495 | B1 | 1/2009 | Alzamora et al. | |
| 7,798,045 | B1 * | 9/2010 | Fitzpatrick et al. | 89/1.4 |
| 7,832,322 | B1 * | 11/2010 | Hoel | 89/1.4 |
| 7,849,777 | B1 * | 12/2010 | Zedrosser | 89/1.4 |
| 8,141,285 | B2 | 3/2012 | Brown | |
| 8,156,854 | B2 * | 4/2012 | Brown | 89/1.4 |
| 8,181,563 | B1 * | 5/2012 | Peterken | 89/191.01 |
| 8,266,998 | B1 * | 9/2012 | Davis | 89/1.4 |
| 2002/0046642 | A1 | 4/2002 | Murello | |
| 2003/0074822 | A1 | 4/2003 | Faifer | |
| 2005/0115134 | A1 | 6/2005 | Bond et al. | |
| 2005/0115398 | A1 | 6/2005 | Olson | |
| 2005/0262752 | A1 | 12/2005 | Robinson et al. | |
| 2006/0065112 | A1 | 3/2006 | Kuczynko et al. | |
| 2006/0156606 | A1 * | 7/2006 | Robinson et al. | 42/7 |
| 2006/0236582 | A1 | 10/2006 | Lewis et al. | |
| 2006/0254112 | A1 | 11/2006 | Snoderly | |
| 2007/0033851 | A1 | 2/2007 | Hochstrate et al. | |
| 2007/0199435 | A1 | 8/2007 | Hockstrate et al. | |
| 2008/0110074 | A1 | 5/2008 | Bucholtz et al. | |
| 2009/0000173 | A1 * | 1/2009 | Robinson et al. | 42/75.02 |
| 2009/0007477 | A1 | 1/2009 | Robinson et al. | |
| 2009/0031605 | A1 | 2/2009 | Robinson | |
| 2009/0031606 | A1 | 2/2009 | Robinson et al. | |
| 2009/0031607 | A1 | 2/2009 | Robinson et al. | |
| 2009/0064556 | A1 * | 3/2009 | Fluhr et al. | 42/14 |
| 2010/0000396 | A1 * | 1/2010 | Brown | 89/1.4 |
| 2011/0083551 | A1 * | 4/2011 | Sirochman | 89/191.01 |
| 2011/0271827 | A1 * | 11/2011 | Larson et al. | 89/193 |
| 2012/0152105 | A1 * | 6/2012 | Gomez et al. | 89/191.01 |
| 2012/0260793 | A1 * | 10/2012 | Gomez | 89/191.01 |
| 2012/0318124 | A1 * | 12/2012 | Brown | 89/1.4 |
| 2013/0047833 | A1 * | 2/2013 | Steimke et al. | 89/191.01 |
| 2013/0174457 | A1 * | 7/2013 | Gangl et al. | 42/16 |

OTHER PUBLICATIONS

Article entitled "M26 Modular Accessory Shotgun System" from Wikipedia, the free encyclopedia dated Jun. 2008; http://en.wikipedia.org/wiki/M26_Modular_Accessory_Shotgun_System.

Article entitled "The USA's M4 Carbine Controversy" dated Feb. 2, 2009; www.defenseindustrydaily.com/the-usas-m4-carbine-controversy-03289/.

Article entitled "M4 Carbine Review" dated May 2, 2007; http://home.comcast.net/shooter2_indy/m4.html.

Article entitled "Critics Turn Crosshairs on Military's Main Rifle" dated Apr. 20, 2008 from the website "USA Today"; www.usatoday.com/news/military/2008-04-20-gunwars_N.htm.

Parts Schematic entitled "Schematic for Bushmaster M4A3 Carbine" from the website "Bushmaster" dated Jun. 2008; www.bushmaster.com/electronic-documents/operation-manual/opmanual.pdf.

Article entitled "M26 Modular Accessory Shotgun Systems Photos and Video" from the website "The Firearm Blog" dated Nov. 2, 2011; www.thefirearmblog.com/blog/2007/11/02/m26-modular-accessory-shotgun-system-photos-and-video/.

Catalog item LMT: Standard MRP (rifle) version from the website "Lewis Machine Tool Company" dated Jun. 2008; www.lewismachine.net/product.php?p=56&cid=8&session=85945e8b595ef2d461b8980961cf870a.

* cited by examiner

FIREARM HAVING A HANDLE ASSEMBLY FOR CHARGING AND FORWARD ASSIST

CROSS-REFERENCE TO RELATED APPLICATIONS

The subject patent application claims priority to and all the benefits of U.S. Provisional Patent Application No. 61/573,555 filed on Sep. 8, 2011, which is incorporated herein by reference in its entirety.

BACKGROUND OF THE INVENTION

1. Field of the Invention

The subject invention relates to firearms and more specifically to a device for moving components of the firearm in a charging motion and in a forward assist motion.

2. Description of the Related Art

Firearms typically include a receiver that houses several working components of the firearm, including firing components, with a barrel extending from the receiver. There are various classes of firearms that operate in different manners. One class of firearm utilizes a bolt carrier disposed in the receiver that is moveable between a firing position, from which a live round of ammunition can be fired, and a rearward position, from which a spent casing is ejected. The movement of the bolt carrier and ejection of the casing can be accomplished with a direct gas impingement or indirect gas impingement system. Examples of gas impingement type firearms include the M16, the M4®, such as the M4® carbine, and the AR-15®, such as the AR-15® Platform.

Firearms having the direct gas impingement system typically include an ejection port defined by the receiver. Direct gas impingement systems route exhaust gases back through the firearm to move the bolt carrier toward the rearward position. In particular, after firing the firearm, the direct gas impingement system routes exhaust gases, including any associated debris, from the barrel, back through a return tube to the bolt carrier, and out the ejection port of the receiver.

Firearms having an indirect gas impingement system do not route the exhaust gases back to the bolt carrier in an effort to reduce fouling caused by the exhaust gases that may occur with direct gas impingement type firearms. Instead, the exhaust gases are used to move a device, such as a piston, that engages the bolt carrier to move the bolt carrier toward the rearward position.

Both the direct and indirect gas impingement systems require an initial manual movement of the bolt carrier from the firing position toward the rearward position to initially load a live round into the firearm. In order to accomplish this manual movement, a device known as a charging handle can be provided at the rear of the receiver near the buttstock. In such a configuration, a user must lower the firearm and manually grasp the charging handle and pull the charging handle toward the buttstock. The charging handle engages the bolt carrier directly to retract the bolt carrier.

During operation, the bolt carrier automatically moves between the firing and rearward positions to eject a spent casing and to load a live round. Debris can build up in the receiver and about the firing components such that during these operations the firearm can jam or fail with either the casing not being fully ejected or the round not being fully loaded into the firearm. In such situations, the charging handle can be utilized to fully eject the casing. Further, another manual device known as a forward assist can be utilized to complete the loading operation of the live round. The forward assist can be a separate device that is also mounted to the rear of the receiver near the buttstock. Again, in such a configuration, the user must lower the firearm and manually push on the forward assist in an attempt to move the bolt carrier to the firing position.

Although necessary, the lowering of the firearm during combat situations to perform these tasks is undesirable. Further, it is inefficient to have the charging handle and the forward assist be two separate mechanisms. As such, there remains a need to improve these components and their associated operation with a robust design that can be easily manufactured and assembled and can be used in a retrofitted design for existing firearms.

SUMMARY OF THE INVENTION AND ADVANTAGES

The present invention includes a charging mechanism for a firearm. The charging mechanism comprises a bolt carrier extending along a longitudinal axis. An elongated member is fixed relative to the bolt carrier and extends along the longitudinal axis and defines a recess. A handle assembly has a base and is moveable with the elongated member in a charging motion. The handle assembly engages the elongated member during the charging motion for moving the bolt carrier toward a rearward position. The bolt carrier presents a first surface and the handle assembly terminates at a terminal surface aligned with the first surface along the longitudinal axis. The terminal surface of the handle assembly abuts the first surface of the bolt carrier when the handle assembly is moved in the charging motion.

The present invention also includes a firearm comprising a receiver defining a receiver bore extending along a longitudinal axis. A bolt carrier is disposed in the receiver bore and is moveable relative to the receiver along the longitudinal axis between a firing position and a rearward position. An elongated member is fixed relative to the bolt carrier and extends along the longitudinal axis. A hand guard is coupled to the receiver and is disposed about the elongated member. A handle assembly slideably engages the elongated member in the hand guard as the bolt carrier moves between the firing position and the rearward positions. The handle assembly is moveable toward the receiver to define a charging motion and the handle assembly engages the elongated member during the charging motion. A track is fixed relative to the hand guard for guiding the handle assembly in the charging motion. The elongated member and the handle assembly define a slot therebetween receiving the track as the handle assembly is moved in the charging motion.

Accordingly, the handle assembly has a robust design that provides several significant advantages. As the bolt carrier is moved in the charging motion, the terminal surface of the handle assembly simply abuts the elongated member. This results in a simple interaction between the handle assembly and the elongated member, i.e., a mere abutting of surfaces, to move the bolt carrier in the charging motion. This simple operation reduces the opportunity for malfunction in the interaction between the handle assembly and the elongated member. Further, the lack of internally receiving parts between the handle assembly and the elongated member results in ease of manufacturing and ease of assembly in the factory and in the field.

The interaction between the handle assembly and the hand guard is also an advantageously robust design. Since the slot is defined between the handle and the elongated member, the track guides both the handle assembly and the elongated member when the handle assembly and the elongated member move together as a unit and individually guides the handle assembly and the elongated member when the handle assembly and/or elongated member move relative to each other. In addition, the interaction of the track with the slot of both the elongated member and the handle reduces moving parts thereby reducing the opportunity for malfunction. In addition, the track is protected by the hand guard. The slot between the elongated member and the handle assembly also allows the elongated member and handle assembly to be used in retrofitted designs for pre-existing firearms that include the track.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
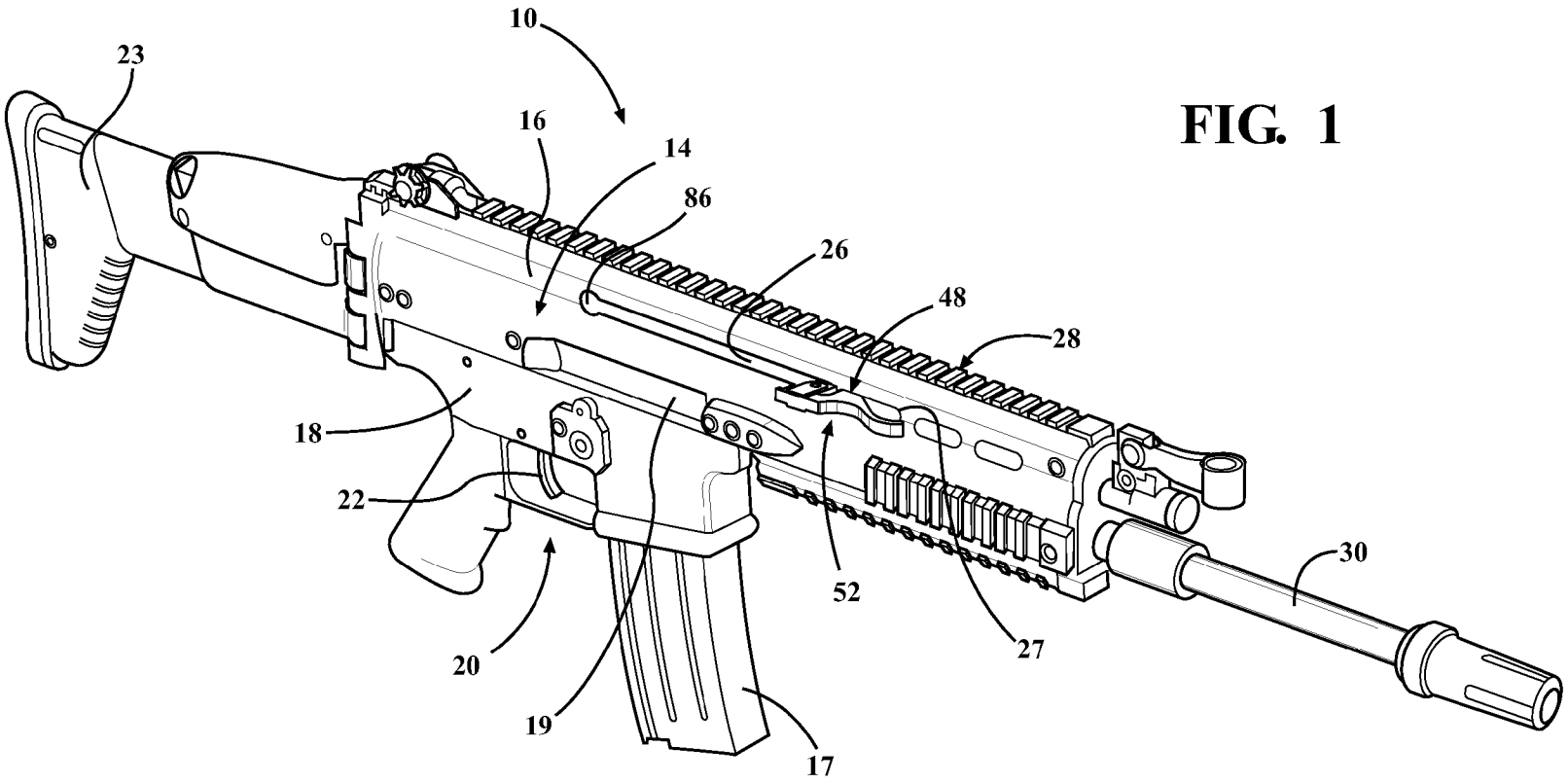
FIG. 1 is a perspective view of a firearm.

Referring to the Figures, wherein like numerals indicate like parts throughout the several views, a firearm 10 is generally shown in FIG. 1. The firearm 10 receives and fires a live round of ammunition (hereinafter "live round"), also referred to as a cartridge, which includes a casing 11, a bullet 13, and other components to propel the bullet 13.

The firearm 10 can be of a certain class of firearms 10 that utilize an indirect gas impingement system to eject a spent casing after firing the firearm 10. Generally indirect gas impingement systems include a piston assembly 12 in communication with a barrel 30 of the firearm 10 for receiving exhaust gas from the barrel 30. The piston assembly 12 limits the introduction of exhaust gas into the firearm 10 otherwise associated with direct gas impingement systems to reduce fouling and thus increase reliability of the firearm 10. Examples of such types of firearms 10 include the Special Operations Forces (SOF) Combat Assault Rifle (SCAR™), such as FN SCAR™. However, it should be appreciated that the firearm 10 can be of any suitable type without departing from the nature of the present invention. The firearm 10 described herein is designed to permit easy retrofitting of the components to a variety of currently and/or previously manufactured firearm designs.

Figure 2:
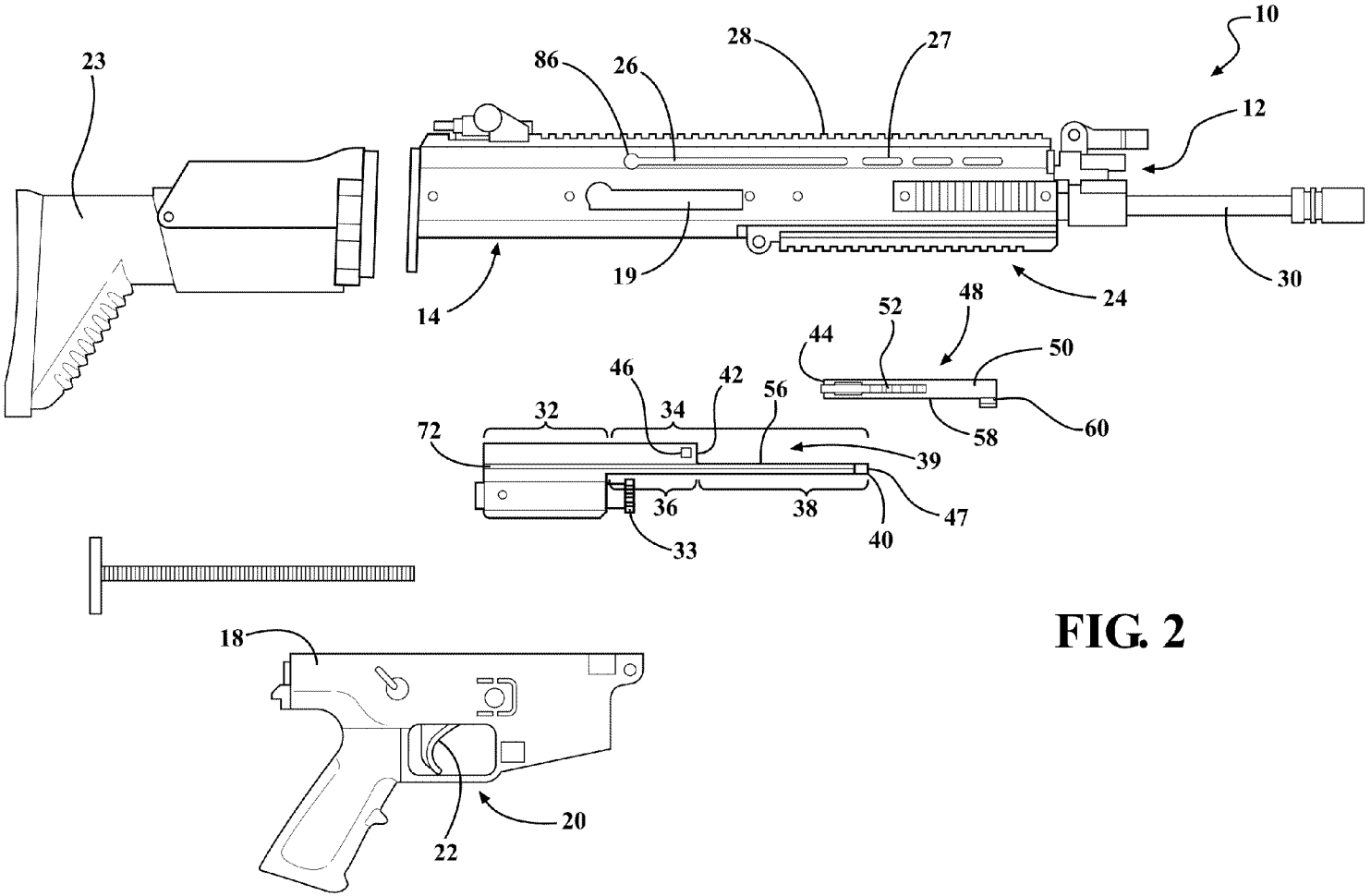
FIG. 2 is a partially exploded view of the firearm.
Figure 3:
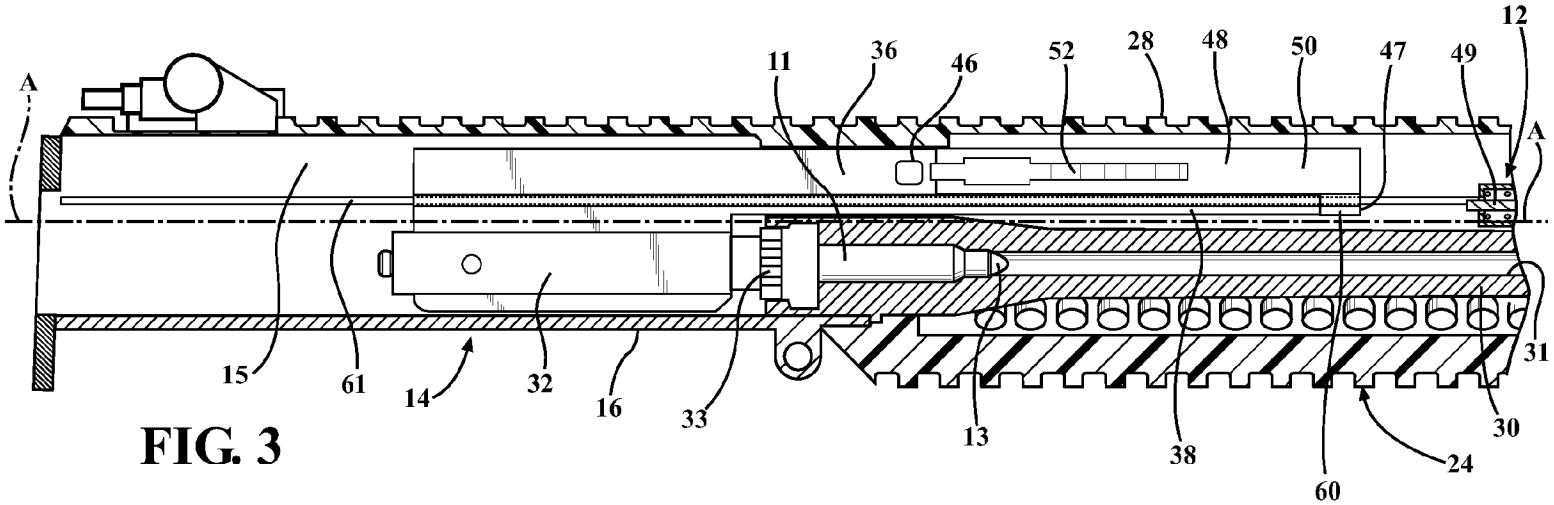
FIG. 3 is a cross-sectional view of a portion of the firearm including a bolt carrier in a firing position.
Figure 4:
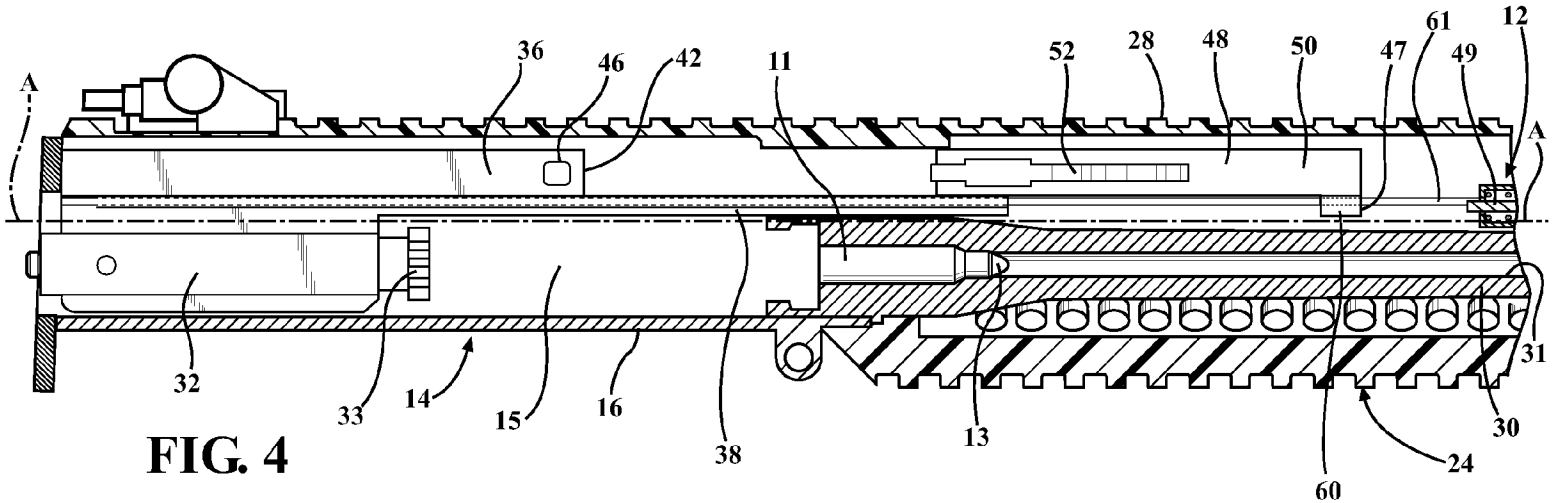
FIG. 4 is a cross-sectional view of the portion of the firearm including the bolt carrier in a rearward position.
Figure 5:
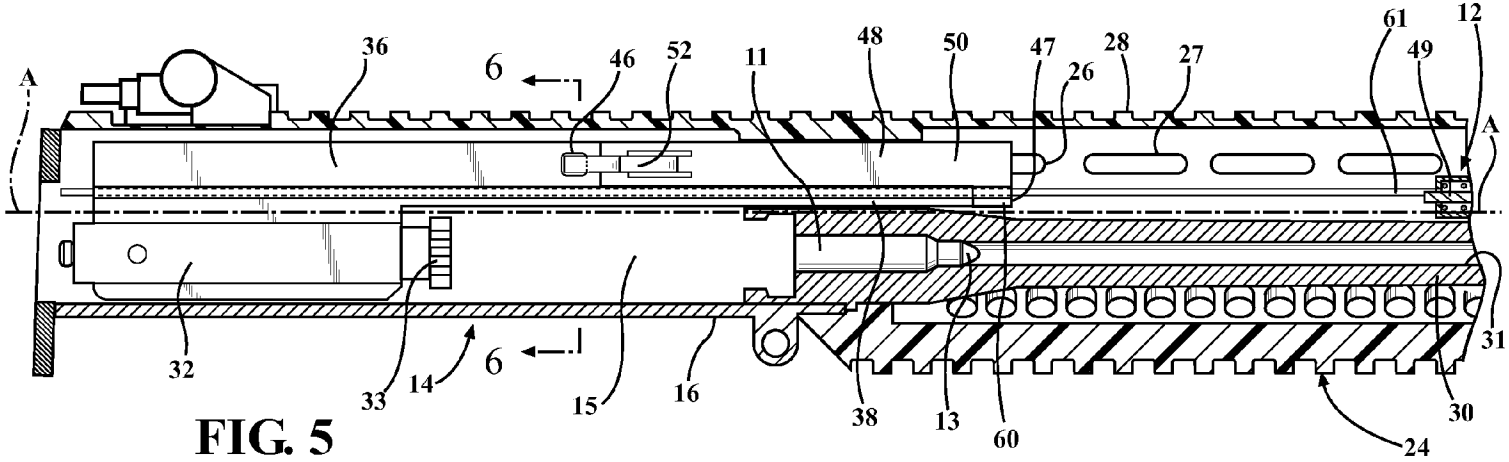
FIG. 5 is a cross-sectional view of the portion of the firearm including a handle assembly moved in a charging motion and the bolt carrier in the rearward position.

With reference to FIGS. 1 and 2, the firearm 10 includes a receiver 14. With reference to FIGS. 3-5, the receiver 14 defines a receiver bore 15 extending along a longitudinal axis A for housing several working components of the firearm 10. The receiver 14 is typically divided into an upper receiver portion 16 and a lower receiver portion 18 attached to the upper receiver portion 16. The upper receiver portion 16 defines an ejection port 19 transverse to the longitudinal axis A for discharging spent casing when firing the firearm 10. The receiver 14 can be of any suitable configuration without departing from the nature of the present invention.

With reference to FIGS. 1 and 2, the firearm 10 also includes a magazine 17, also referred to as a clip, detachably mounted to the lower receiver portion 18. Generally, the magazine 17 is loaded with a plurality of live rounds. The magazine 17 can be of any suitable configuration without departing from the nature of the present invention.

With continued reference to FIGS. 1 and 2, the firearm 10 includes a trigger assembly 20 supported by the receiver 14 and having a trigger 22. Engagement of the trigger 22 fires the firearm 10. The trigger assembly 20 is typically at least partially disposed in the lower receiver portion 18.

The firearm 10 includes a buttstock 23 coupled to the receiver 14. The buttstock 23 extends rearwardly from the receiver 14 for abutting a shoulder of the user for supporting the firearm 10. The buttstock 23 can be of any suitable configuration without departing from the nature of the present invention.

The firearm 10 includes a hand guard 24 coupled to the receiver 14. The hand guard 24 extends forwardly from the receiver 14 such that a user can hold the hand guard 24 of the firearm 10 for supporting the firearm 10. The hand guard 24 can be integral with at least a portion of the receiver 14, such as, for example, the upper receiver portion 16. The hand guard 24 is typically spaced from the buttstock 23.

The hand guard 24 defines a slot 26 extending along the longitudinal axis A, i.e., substantially parallel to the longitudinal axis A. The hand guard 24 also defines a second slot 27 spaced from the slot 26 along the longitudinal axis A.

The hand guard 24 can include a series of connection points commonly known in the industry as a rail system 28 for mounting additional components (not shown) to the hand guard 24. Examples of components mountable to the rail system 28 include bipods, tripods, scopes, bayonets, lasers, shot guns, grenade launchers, etc.

With continued reference to FIGS. 1 and 2, the firearm 10 includes a barrel 30 coupled to the receiver 14 for receiving the live rounds. The barrel 30 extends along the longitudinal axis A, i.e., substantially parallel to the longitudinal axis A. The hand guard 24 extends radially around a portion of the barrel 30.

With reference to FIGS. 3-5, the barrel 30 includes a breech (not numbered) adjacent the receiver 14 and a muzzle (not numbered) spaced from the breech. The breech defines a chamber 31 for receiving the live rounds. Specifically, the live rounds are individually loaded into the chamber 31 from the magazine 17. The barrel 30 can be of any suitable configuration without departing from the nature of the present invention.

With reference to FIGS. 2-5, the firearm 10 includes a bolt carrier 32 movably disposed in the receiver bore 15. The bolt carrier 32 is movable along the longitudinal axis A between a firing position (shown in FIG. 3) and a rearward position (shown in FIGS. 4 and 5).

A bolt 33 and a firing pin (not shown) are carried by the bolt carrier 32. When the trigger 22 is actuated, the firing pin strikes the live round to fire the bullet 13 out of the barrel 30. The bolt carrier 32 and/or the bolt 33 generally include features for automatically expelling the spent casing from the firearm 10 when the bolt carrier 32 moves from the firing position to the rearward position and for automatically feeding another live round from the magazine 17 to the chamber 31 when the bolt carrier 32 moves from the rearward position to the firing position. When the bolt carrier 32 is in the firing position, the bolt 33 locks to the breech of the barrel 30 to hold the live round in the chamber 31.

Figure 7:
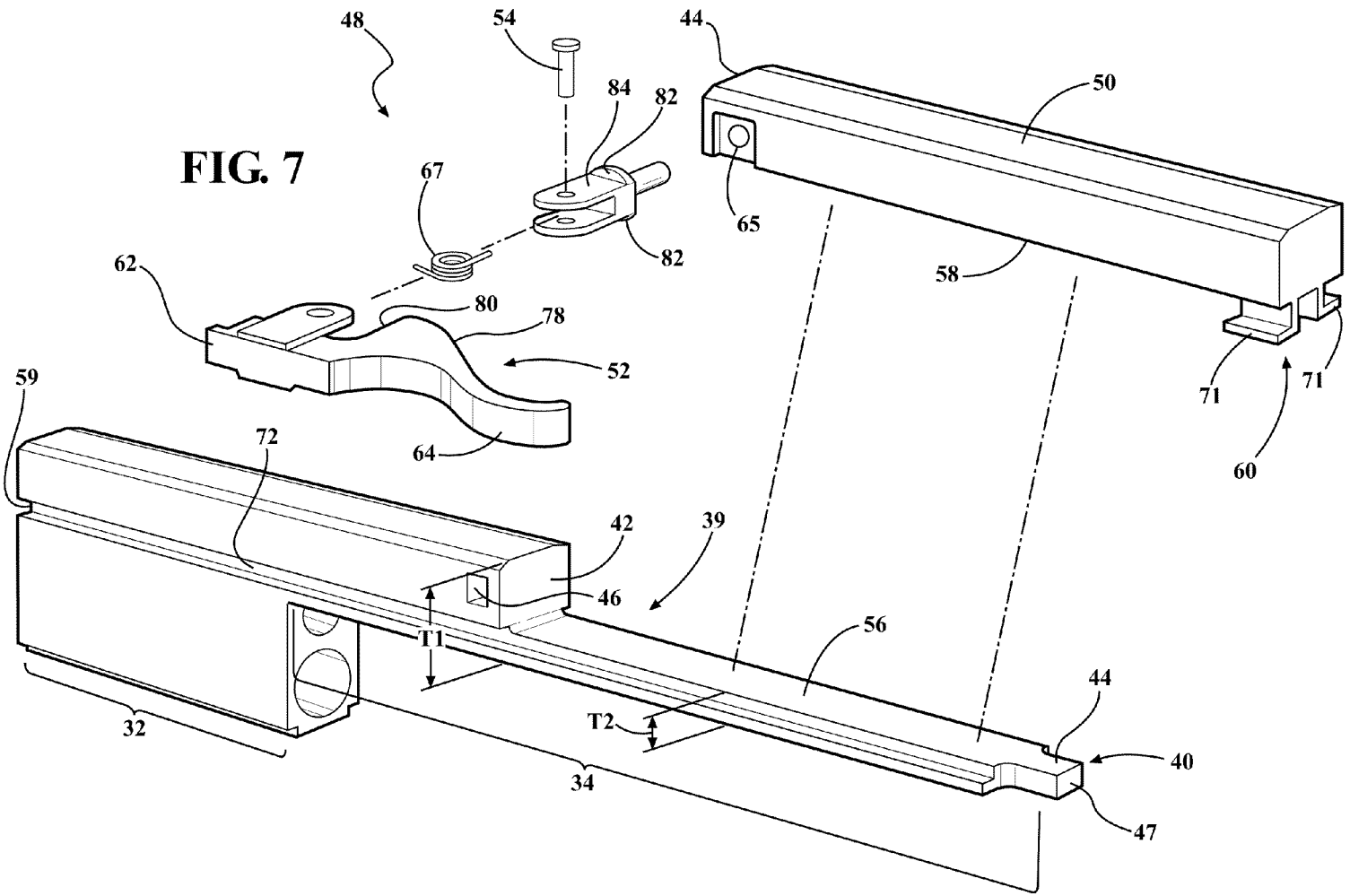
FIG. 7 is an exploded view of the handle assembly.
Figure 8:
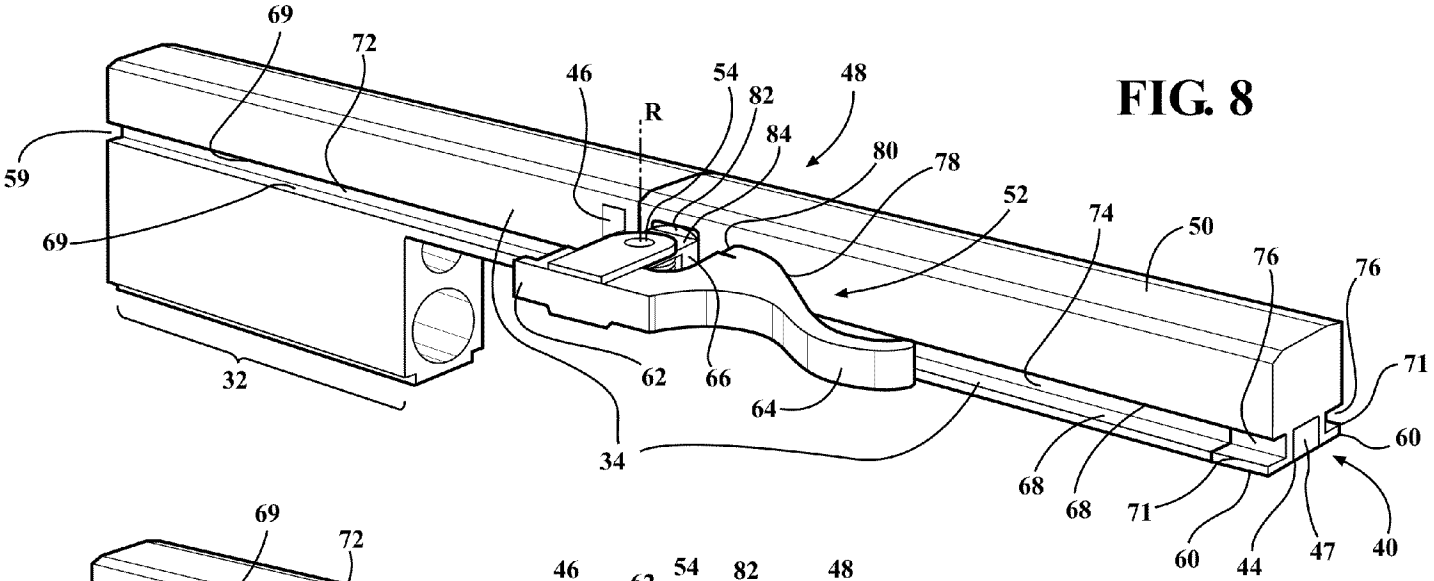
FIG. 8 is a perspective view of the handle assembly with the arm of the handle assembly in a disengaged position.
Figure 9:
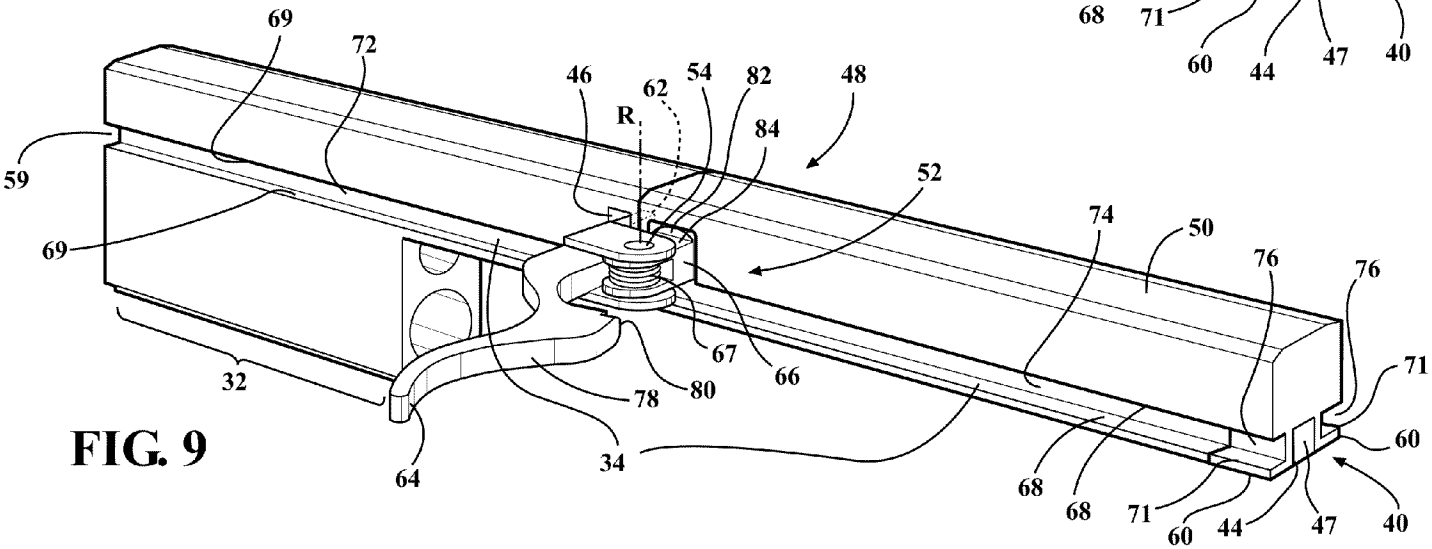
FIG. 9 is a perspective view of the handle assembly with the arm of the handle assembly in the engaged position.

With reference to FIGS. 7-9, the firearm 10 includes an elongated member 34 fixed relative to the bolt carrier 32 and extending along the longitudinal axis A, i.e. substantially parallel to the longitudinal axis A. In other words, the bolt carrier 32 and the elongated member 34 are fixed relative to each other so as to move together as a unit between the firing position and the rearward position. The hand guard 24 is disposed about the elongated member 34. In the embodiment shown in the Figures, the elongated member 34 is integrally formed with the bolt carrier 32, i.e., are formed together as a one-piece unit. Alternatively, the elongated member 34 can be formed separately from the bolt carrier 32 and subsequently affixed to the bolt carrier 32, for example, by welding, fastening, adhering, etc.

The elongated member 34 includes a first portion 36 extending from the bolt carrier 32 and a second portion 38 extending from the first portion 36. The second portion 38 has a reduced cross-section compared to the first portion 36, i.e., is thinner than the first portion 36. In other words, the first portion 36 has a first thickness T1 and the second portion has a second thickness T2 less than the first thickness T1. The first portion 36 and second portion 38 define a cutout 39 therebetween.

With reference to FIG. 7, the second portion 38 extends from the first portion 36 to a distal end 40 spaced from the first portion 36. The second portion 38 includes a key 44 at the distal end 40. The key 44 defines a striking surface 47 and the piston assembly 12 includes a piston 49 that selectively engages the striking surface 47. More specifically, the piston 49 is aligned with the elongated member 34 along the longitudinal axis A when the bolt carrier 32 is in the firing position. When the firearm 10 is fired, exhaust gas from the barrel 30 forces the piston 49 to move along the longitudinal axis A toward the striking surface 47 to strike the striking surface 47, which moves the elongated member 34 and the bolt carrier 32 from the firing position to the rearward position.

With reference to FIG. 1, the firearm 10 includes a handle assembly 48. The handle assembly 48 slideably engages the elongated member 34 in the hand guard 24 as the bolt carrier 32 moves between the firing position and the rearward position.

The handle assembly 48 is moveable toward the receiver 14 to define a charging motion and away from the receiver 14 to define a forward assist motion. The handle assembly 48 extends from the hand guard 24 through the slot 26 and the handle assembly 48 moves along the slot 26 as the handle assembly 48 moves in the charging motion and the forward assist motion.

The handle assembly 48 is disposed above the elongated member 34. When the bolt carrier 32 is in the firing position and/or when the handle assembly 48 is moved in the charging motion or forward assist motion, the handle assembly 48 is disposed in the cutout 39 between the first portion 36 and the second portion 38 of the elongated member 34. The handle assembly 48 engages the elongated member 34 during the charging motion and during the forward assist motion to move the elongated member 34, and the bolt carrier 32, in the charging motion and the forward assist motion. The bolt carrier 32, the elongated member 34, and the handle assembly 48 define a charging/forward assist mechanism for the firearm 10.

With reference to FIGS. 7-9, the handle assembly 48 includes a base 50 slideably engaging the elongated member 34 and an arm 52 coupled to the base 50. The arm 52 is moveable relative to the base 50 between a disengaged position (shown in FIG. 8) spaced from the elongated member 34 and an engaged position (shown in FIGS. 6 and 9) abutting the elongated member 34. Specifically, the arm 52 is rotatably coupled to the base 50 about a rotational axis R and is rotatable relative to the base 50 between the engaged position and the disengaged position, as set forth further below.

The handle assembly 48 includes a platform 66 engaged with the base 50 and extending through the slot 26. The arm 52 is pinned to the platform 66 with a pin 54 disposed along the rotational axis R. The arm 52 rotates relative to the platform 66 about the pin 54, i.e., about the rotational axis R.

The base 50 of the handle assembly 48 defines a hole 65, as best shown in FIGS. 7-9, that slideably receives the platform 66. Specifically, the platform 66 includes a shoulder 82 received in the hole 65 and a neck 84 extending from the shoulder 82. The neck 84 receives the pin 54 and supports the arm 52.

The shoulder 82 is wider than the slot 26 and the neck 84 is thinner than the slot 26. As such, once assembled, the shoulder 82 retains the platform 66 with the base 50 in the hand guard 24 and the neck 84 extends through the slot 26 to support the arm 52 exterior to the hand guard 24.

To assemble the handle assembly 48 to the hand guard 24, the base 50 of the handle assembly 48, the elongated member 34, and the bolt carrier 32 are inserted into the receiver bore 15. An enlarged opening 86, shown in FIGS. 1 and 2, is open to the slot 26 and is sized and shaped to receive the platform 66 therethrough. The base 50 of the hand guard 24 is aligned with the enlarged opening 86 and the platform 66 is inserted through the enlarged opening 86 into the hole 65 of the base 50. Specifically, the shoulder 82 is inserted through the enlarged opening 86 with the neck 84 extending through the enlarged opening 86. The handle assembly 48 is then moved forward along the longitudinal axis A into the slot 26 with the neck 84 riding along the slot 26. The arm 52 can be assembled to the platform 66 before or after the shoulder 82 is moved into the slot 26. The buttstock 23 is then assembled to the receiver 14. The buttstock 23 is sized and shaped to prevent the bolt carrier 32 from moving rearwardly along the longitudinal axis A to the enlarged opening 86. Said differently, once the buttstock 23 is assembled to the receiver 14, the platform 66 of the handle assembly 48 is retained in the hand guard 24 because the shoulder 82 is wider than the slot 26 and is thus retained in the hand guard 24.

As set forth above, the arm 50 is moveable between the engaged position and the disengaged position. The first portion 36 of the elongated member 34 defines a recess 46 facing the slot 26 of the hand guard 24. When the arm 50 of the handle assembly 48 is moved to the engaged position, the handle assembly 48 engages the recess 46 to engage the handle assembly 48 and the elongated member 34 such that the handle assembly 48 and the elongated member 34 move together as a unit along the longitudinal axis A. Specifically, the arm 52 includes a finger grip 64 and a projection 62 and the recess 46 receives the projection 62 when the arm 52 is in the engaged position. When the arm 50 is moved to the disengaged position, the projection 62 disengages the recess 46 such that the handle assembly 48 and the elongated member 34 can move independently.

When the finger grip 64 is actuated by a user, i.e., grasped and rotated by the user, the finger grip 64 and the projection 62 concurrently move about the pin 54. The arm 52 is moveable relative to the pin 54 between the engaged position with the projection 62 engaging the elongated member 34 and the disengaged position with the projection 62 disengaged from the elongated member 34. The projection 62 and the finger grip 64 move together as a unit about the pin 54.

The arm 52 is biased to the disengaged position. For example, as shown in FIGS. 7 and 8, the handle assembly 48 can include a biasing member 67 for biasing the arm 52 to the disengaged position. As such, when the user releases the finger grip 64, the finger grip 64 and the projection 62 automatically rotate about the pin 54 to the disengaged position such that the projection 62 disengages the recess 46 of the elongated member 34.

The handle assembly 48 is typically stored in a home position along the longitudinal axis A, as shown in FIG. 1, when the firearm 10 is used during normal operation. In the home position, the arm 50 engages the second slot 27 to retain the handle assembly 48 in the home position as the elongated member 34 moves during firing of the firearm 10. Specifically, the arm 52 includes a locking surface 80 that engages the second slot 27. When the handle assembly 48 is in the home position, the biasing member 67 biases the arm 52 into the second slot 27 and the locking surface 80 abuts the second slot 27 to maintain the handle assembly 48 in the home position.

When the handle assembly 48 is away from the home position, the handle assembly 48 automatically returns to the home position when the bolt carrier 32 is moved to the firing position. With continued reference to FIGS. 7-9, the arm 52 includes a chamfered surface 78. If the handle assembly 48 is away from the home position and in the disengaged position, the handle assembly 48 is forced toward the home position as the bolt carrier 32 moves to toward the firing position. As the handle assembly 48 approaches the home position, the chamfered surface 78 contacts the hand guard 24 between the slot 26 and the slot 27. At this point, the biasing member 67 is overcome and the chamfered surface 78 rides along the hand guard 24 between the slot 26 and the second slot 27. When the handle assembly 48 reaches the home position, the biasing member 67 biases the locking surface 80 into the second slot 27. The bolt carrier 32 presents a first surface 42 and the handle assembly 48 terminates at a terminal surface 44 aligned with the first surface 42 along the longitudinal axis A. The terminal surface 44 of the handle assembly 48 abuts the first surface 42 of the bolt carrier 32 when the handle assembly 48 is moved in the charging motion.

Figure 6:
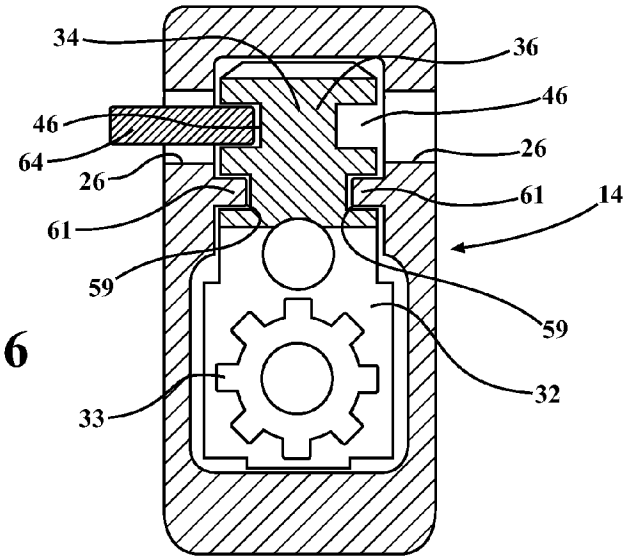
FIG. 6 is a cross-sectional view of the firearm through line 6 of FIG. 5 and with an arm of the handle assembly in the engaged position.

The elongated member 34 includes a support surface 56 extending from the first surface 42 of the bolt carrier 32 along the longitudinal axis A and the handle assembly 48 includes a corresponding surface 58 extending from the terminal surface 44 along the longitudinal axis A in contact with the support surface 56. The support surface 56 and the corresponding surface 58 typically have corresponding shapes such that the support surface 56 slides on the corresponding surface 58 when the bolt carrier 32, and thus the elongated member 34, move between the firing position and the rearward position. For example, the support surface 56 and the corresponding surface 58 are flat, as best shown in FIGS. 6 and 7. However, it should be appreciated that the support surface 56 and the support surface 58 can be of any suitable shape without departing from the nature of the present invention.

The bolt carrier 32, the elongated member 34, and the handle assembly 48 define a slot 59 that receives and rides along the hand guard 24. Specifically, the hand guard 24 includes a track 61 fixed relative to the hand guard 24 and engaging the slot 59. The track 61 extends from the hand guard 24 into the receiver bore 15. While the Figures show the slot 59 defined by the bolt carrier 32, elongated member 34, and handle assembly 48, and the track 61 extends from the hand guard 24, it should be appreciated that in the alternative to or in addition, the hand guard 24 can define at least one slot 59 and the bolt carrier 32, elongated member 34, and handle assembly 48 can include at least one track 61.

The firearm 10 can include any number of corresponding slots 59 and tracks 61. For example, as best shown in FIG. 6, the firearm 10 includes two corresponding slots 59 and tracks 61. In such a configuration, the pair of slots 59 and tracks 61 cooperate to assist in maintaining substantially parallel movement of the bolt carrier 32 along the longitudinal axis A. It should be appreciated that the slot 59 and the track 61 can be of any suitable configuration and orientation.

The elongated member 34 and the handle assembly 48 define the slot 59 therebetween for guiding the handle assembly 48 in the charging motion and the forward assist motion. The elongated member 34 and the handle assembly 48 each present a flange 68 spaced from each other defining the slot 59 therebetween. The slot 59 is, more specifically, defined by each of the bolt carrier 32, the elongated member 34, and the handle assembly 48 when the first surface 42 of the bolt carrier 32 abuts the terminal surface 44 of the handle assembly 48 for guiding the bolt carrier 32, the elongated member 34, and the handle assembly 48 in the charging motion and the forward assist motion.

The bolt carrier 32 defines a first portion 72 of the slot 59. Specifically, the bolt carrier 32 includes opposing walls 69 aligned with the flanges 68 along the longitudinal axis A defining a portion of the track 61 for guiding the bolt carrier 32. The first portion 72 of the slot 59 receives the track 61 such that the bolt carrier 32 rides along the track 61 as the bolt carrier 32 moves between the firing position and the rearward position. The elongated member 34 and the handle assembly 48 define a second portion 74 of the slot 59 therebetween. The second portion 74 of the slot 59 receives the track 61 such that the elongated member 34 and the handle assembly 48 ride along the track 61 as the handle assembly 48 moves in the charging motion and the forward assist motion. The first portion 72 and the second portion 74 are aligned with each other along the longitudinal axis A.

A guide 60 extends from the handle assembly 48 and receives the elongated member 34 when the bolt carrier 32 is in the firing position. Specifically, guide 60 receives the key 44 such that the striking surface 47 is aligned with the piston 49. The guide 60, more specifically, extends from the base 50 of the handle assembly 48. As best shown in FIG. 7, the guide 60 extends from the corresponding surface 58 spaced from the terminal surface 44.

The guide 60 defines a third portion 76 of the slot 59 for guiding the handle assembly 48 in the charging motion and the forward assist motion. Specifically, the guide 60 includes a second flange 71 aligned with the flange 68 of the elongated member 34 defining a portion of the slot 59. The third portion 76 of the slot 59 is aligned with the first portion 72 and the second portion 74 along the longitudinal axis A.

Under normal operation, when the firearm 10 is fired, the elongated member 34 and the bolt carrier 32 concurrently move relative to the handle assembly 48 from the firing position to the rearward position. In other words, the handle assembly 48 does not reciprocate during under normal operation, i.e., is non-reciprocating. When the trigger 22 is pulled, the piston 49 strikes the striking end 47 of the key 44 to move the bolt carrier 32 to the rearward position and the piston 49 does not strike the handle assembly 48 during normal operation.

If the spent casing does not eject from the chamber 31, i.e., becomes jammed, the handle assembly 48 can be manually moved in the charging motion to engage the elongated member 34 to move the elongated member 34 and the bolt carrier 32 toward the rearward position to move the elongated member 34 and the bolt carrier 32 toward the rearward position. Typically, in such a situation, a user grasps the finger grip 64 and pulls the handle assembly 48 in the charging direction. Specifically, when moved in the charging motion, the terminal surface 44 of the base 50 of the handle assembly 48 abuts the first surface of the elongated member 34 to force the elongated member 34, and thus the bolt carrier 32, in the charging motion. Also, when moved in the charging motion, the guide 60 abuts the distal end 40 of the elongated member 34 to force the elongated member 34, and thus the bolt carrier 32, in the charging motion. The projection 62 also engages the base 50 of the handle assembly 48 in the recess 46 to force the elongated member, and thus the bolt carrier 32, to move in the charging motion when the handle assembly 48 is moved in the charging motion.

If the bolt carrier 32 does not automatically move to the firing position, the handle assembly 48 can engage the elongated member 34 and can be moved in the forward assist motion to move the elongated member 34, and thus the bolt carrier 32, toward the firing position. More specifically, the user grasps the finger grip 64 and rotates the finger grip 64 relative to the base 50 about the pin 54 to engage the projection 62 with the recess 46 of the elongated member 34. In such a position, when the handle assembly 48 is moved in the forward assist motion, the projection 62 forces the elongated member 34, and thus the bolt carrier 32, toward the firing position.

The handle assembly 48 can be ambidextrous. In other words, the handle assembly 48 can extend from either side of the hand guard 24 depending upon which hand the user prefers to use the handle assembly 48. For example, the user may prefer to move the handle assembly 48 in the charging motion and/or the forward assist motion when the arm 52 is disposed on a right hand side of the firearm 10 or, alternatively, when the arm 52 is disposed on a left side of the firearm 10.

Typically, the hand guard 24 defines a pair of slots 26 on opposing sides of the hand guard 24 and the elongated member 34 can define a pair of recesses 46 on opposing sides of the elongated member 34, as best shown in FIG. 6. Similarly, the hand guard 24 can define a pair of enlarged members 24 in communication with the pair of slots 26, respectively. The hole 65 of the base 50 that receives the platform 66 can extend through the base 50 for receiving the platform 66 on either side of the firearm 10. Alternatively, the base 50 can define two holes 65 on opposing sides of the base 50 for receiving the platform 65 on either side of the firearm 10. It should be appreciated that the arm 52 can be supported by the base 50 in any suitable location to accommodate the ambidextrous handle assembly 48.

The invention has been described in an illustrative manner, and it should be understood that the terminology which has been used is intended to be in the nature of words of description rather than of limitation. Many modifications and variations of the present invention are possible in light of the above teachings, and the invention may be practiced otherwise than as specifically described.

What is claimed is:

1. A firearm comprising:

a receiver defining a receiver bore extending along a longitudinal axis;

a bolt carrier disposed in said receiver bore and moveable relative to said receiver along said longitudinal axis between a firing position and a rearward position;

an elongated member fixed relative to said bolt carrier and extending along said longitudinal axis;

a hand guard coupled to said receiver and disposed about said elongated member; and a handle assembly slideably engaging with said elongated member in said hand guard as said bolt carrier moves between said firing position and said rearward position, said handle assembly being moveable toward said receiver to define a charging motion with said handle assembly engaging said elongated member during said charging motion;

said bolt carrier presenting a first surface and said handle assembly terminating at a terminal surface aligned with said first surface along said longitudinal axis, said terminal surface of said handle assembly abutting said first surface of said bolt carrier when said handle assembly is moved in said charging motion;

wherein said elongated member and said handle assembly define a slot therebetween for guiding said handle assembly in said charging motion.

2. The firearm as set forth in claim 1 wherein said handle assembly is disposed above said elongated member.

3. The firearm as set forth in claim 1 further comprising a track fixed relative to said hand guard and engaging said slot.

4. The firearm as set forth in claim 1 wherein said bolt carrier, said elongated member, and said handle assembly define a slot when said first surface of said bolt carrier abuts said terminal surface of said handle assembly for guiding said bolt carrier, said elongated member, and said handle assembly in said charging motion.

5. The firearm as set forth in claim 4 wherein said bolt carrier defines a first portion of said slot and wherein said elongated member and said handle assembly define a second portion of said slot therebetween.

6. The firearm as set forth in claim 5 further comprising a guide extending from said handle assembly and receiving said elongated member when said bolt carrier is in said firing position wherein said guide defines a third portion of said slot.

7. The firearm as set forth in claim 1 further comprising a guide extending from said handle assembly and receiving said elongated member when said bolt carrier is in said firing position.

8. The firearm as set forth in claim 7 wherein said guide defines a slot for guiding said handle assembly in said charging motion.

9. The firearm as set forth in claim 1 further comprising a barrel extending from said receiver and a piston assembly in communication with said barrel for receiving exhaust gas from said barrel, said piston in communication with said elongated member when said bolt carrier is in said firing position.

10. A charging mechanism for a firearm, said charging mechanism comprising:

a bolt carrier extending along a longitudinal axis;

an elongated member fixed relative to said bolt carrier and extending along said longitudinal axis and defining a recess; and a handle assembly having a base and being moveable with said elongated member in a charging motion, said handle assembly engaging said elongated member during said charging motion for moving said bolt carrier toward a rearward position;

said bolt carrier presenting a first surface and said handle assembly terminating at a terminal surface aligned with said first surface along said longitudinal axis, said terminal surface of said handle assembly abutting said first surface of said bolt carrier when said handle assembly is moved in said charging motion;

wherein said bolt carrier, said elongated member, and said handle assembly define a slot when said first surface of said bolt carrier abuts said terminal surface of said handle assembly for guiding said bolt carrier, said elongated member, and said handle assembly in said charging motion.

11. The firearm as set forth in claim 10 wherein said elongated member includes a support surface extending from said first surface of said bolt carrier along said longitudinal axis and said handle assembly includes a corresponding surface extending from said terminal surface along said longitudinal axis in contact with said support surface.

12. The firearm as set forth in claim 11 further comprising a guide extending from said corresponding surface spaced from said terminal surface and receiving said elongated member when said bolt carrier is in said firing position.

13. The firearm as set forth in claim 10 wherein said elongated member and said handle assembly define a slot therebetween for guiding said handle assembly in said charging motion.

14. The firearm as set forth in claim 10 further comprising a guide extending from said handle assembly and receiving said elongated member.

15. The firearm as set forth in claim 14 wherein said guide defines a slot for guiding said handle assembly in said charging motion.

16. A firearm comprising:

a receiver defining a receiver bore extending along a longitudinal axis;

a bolt carrier disposed in said receiver bore and moveable relative to said receiver along said longitudinal axis between a firing position and a rearward position;

an elongated member fixed relative to said bolt carrier and extending along said longitudinal axis;

a hand guard coupled to said receiver and disposed about said elongated member;

a handle assembly slideably engaging said elongated member in said hand guard as said bolt carrier moves between said firing position and said rearward positions, said handle assembly being moveable toward said receiver to define a charging motion and with said handle assembly engaging said elongated member during said charging motion; and a track fixed relative to said hand guard for guiding said handle assembly in said charging motion;

said elongated member and said handle assembly defining a slot therebetween receiving said track as said handle assembly is moved in said charging motion.

17. The firearm as set forth in claim 16 wherein said elongated member and said handle assembly each present a flange spaced from each other defining said slot therebetween.

18. The firearm as set forth in claim 17 further comprising a guide extending from said handle assembly and receiving said elongated member when said bolt carrier is in said firing position, said guide including a second flange aligned with said flange of said elongated member defining a portion of said slot.

19. The firearm as set forth in claim 17 wherein said bolt carrier includes opposing walls aligned with said flanges defining a portion of said slot for guiding said bolt carrier.

20. The firearm as set forth in claim 16 wherein said handle assembly is moveable away from said receiver to define a forward assist motion with said handle assembly engaging said elongated member during said forward assist motion.

21. A firearm comprising:

a receiver defining a receiver bore extending along a longitudinal axis;

a bolt carrier disposed in said receiver bore and moveable relative to said receiver along said longitudinal axis between a firing position and a rearward position; an elongated member fixed relative to said bolt carrier and extending along said longitudinal axis to a distal end;

a hand guard coupled to said receiver and disposed about said elongated member; and a handle assembly slideably engaging with said elongated member in said hand guard as said bolt carrier moves between said firing position and said rearward position, said handle assembly being moveable toward said receiver to define a charging motion with said handle assembly engaging said elongated member during said charging motion;

said bolt carrier presenting a first surface and said handle assembly terminating at a terminal surface aligned with said first surface along said longitudinal axis, said terminal surface of said handle assembly abutting said first surface of said bolt carrier when said handle assembly is moved in said charging motion;

wherein said elongated member includes a support surface extending from said first surface of said bolt carrier along said longitudinal axis to said distal end; and said handle assembly including a corresponding surface extending from said terminal surface along said longitudinal axis to an opposing terminal end of said handle assembly with said corresponding surface of said handle assembly between said terminal surface and terminal end in contact with said support surface of said elongated member during said charging motion.

22. The firearm as set forth in claim 21 further comprising a guide extending from said corresponding surface spaced from said terminal surface and receiving said elongated member when said bolt carrier is in said firing position.

23. The firearm as set forth in claim 21 wherein said support surface between said first surface and said distal end is entirely flat, and wherein said corresponding surface between said terminal surface and said opposing terminal end is entirely flat.

24. A firearm comprising:

a receiver defining a receiver bore extending along a longitudinal axis;

a bolt carrier disposed in said receiver bore and moveable relative to said receiver along said longitudinal axis between a firing position and a rearward position;

an elongated member fixed relative to said bolt carrier and extending along said longitudinal axis;

a hand guard coupled to said receiver and disposed about said elongated member; and a handle assembly slideably engaging with said elongated member in said hand guard as said bolt carrier moves between said firing position and said rearward position, said handle assembly being moveable toward said receiver to define a charging motion with said handle assembly engaging said elongated member during said charging motion;

said bolt carrier presenting a first surface and said handle assembly terminating at a terminal surface aligned with said first surface along said longitudinal axis, said terminal surface of said handle assembly abutting said first surface of said bolt carrier when said handle assembly is moved in said charging motion;

wherein said handle assembly includes a base slideably engaging said elongated member and an arm coupled to said base and moveable between a disengaged position spaced from said elongated member and an engaged position abutting said elongated member.

25. The firearm as set forth in claim 24 wherein said arm is rotatably coupled to said base about a rotational axis and is rotatable relative to said base between said engaged position and said disengaged position.

26. The firearm as set forth in claim 24 wherein said arm includes a finger grip and a projection and said bolt carrier defines a recess that receives said projection when said arm is in said engaged position.

27. A firearm comprising:

a receiver defining a receiver bore extending along a longitudinal axis;

a bolt carrier disposed in said receiver bore and moveable relative to said receiver along said longitudinal axis between a firing position and a rearward position;

an elongated member fixed relative to said bolt carrier and extending along said longitudinal axis;

a hand guard coupled to said receiver and disposed about said elongated member; and a handle assembly slideably engaging with said elongated member in said hand guard as said bolt carrier moves between said firing position and said rearward position, said handle assembly being moveable toward said receiver to define a charging motion with said handle assembly engaging said elongated member during said charging motion;

said bolt carrier presenting a first surface and said handle assembly terminating at a terminal surface aligned with said first surface along said longitudinal axis, said terminal surface of said handle assembly abutting said first surface of said bolt carrier when said handle assembly is moved in said charging motion;

wherein said handle assembly is moveable away from said receiver to define a forward assist motion with said handle assembly engaging said elongated member during said forward assist motion.

28. A charging mechanism for a firearm, said charging mechanism comprising:

a bolt carrier extending along a longitudinal axis;

an elongated member fixed relative to said bolt carrier and extending along said longitudinal axis and defining a recess; and a handle assembly having a base and being moveable with said elongated member in a charging motion, said handle assembly engaging said elongated member during said charging motion for moving said bolt carrier toward a rearward position;

said bolt carrier presenting a first surface and said handle assembly terminating at a terminal surface aligned with said first surface along said longitudinal axis, said terminal surface of said handle assembly abutting said first surface of said bolt carrier when said handle assembly is moved in said charging motion;

wherein said handle assembly includes a base slideably engaging said elongated member and an arm coupled to said base and moveable between a disengaged position spaced from said elongated member and an engaged position abutting said elongated member.

29. The firearm as set forth in claim 28 wherein said arm includes a finger grip and a projection and said bolt carrier defines a recess that receives said projection when said arm is in said engaged position.

* * * * *